United States Patent [19]

Fujita et al.

[11] 4,292,137

[45] Sep. 29, 1981

[54] DOOR LIFTER FOR COKE OVEN

[75] Inventors: Kenji Fujita; Yuji Shibata; Hisao Mikuni, all of Yokosuka; Tsuneo Shibuya, Okazaumachi, all of Japan

[73] Assignee: Sumitomo Heavy Industries, Ltd., Tokyo, Japan

[21] Appl. No.: 184,308

[22] Filed: Sep. 5, 1980

[30] Foreign Application Priority Data

Sep. 7, 1979 [JP] Japan ..... 54-114883
Sep. 22, 1979 [JP] Japan ..... 54-122481

[51] Int. Cl.[3] ..... C10B 25/14
[52] U.S. Cl. ..... 202/248; 212/166
[58] Field of Search ..... 202/248, 270, 262; 212/166

[56] References Cited

U.S. PATENT DOCUMENTS 2,972,422 2/1961 Stone ..... 212/166
3,948,397 4/1976 Ikio ..... 202/248 X
4,225,393 9/1980 Gregor et al. ..... 202/248

FOREIGN PATENT DOCUMENTS 1073436 1/1960 Fed. Rep. of Germany ..... 202/248
51-25503 3/1976 Japan .

*Primary Examiner*—Frank W. Lutter
*Assistant Examiner*—Roger F. Phillips
*Attorney, Agent, or Firm*—Armstrong, Nikaido, Marmelstein & Kubovcik

[57] ABSTRACT

An door lifter for coke ovens is provided with a door lifting or lowering power actuator consisting of two hydraulic cylinders connected in series and in back-to-back relationship. In the case of the door removal, first one of the two hydraulic cylinders is actuated so that the hooks are made into engagement with the corresponding lug pieces of the door and when they have engaged, said one hydraulic cylinder is stopped and locked. Thereafter the other hydraulic cylinder is actuated so that the door is lifted to be removed from the oven. In order to reengage the door, the other hydraulic cylinder is reversely actuated so that the door is lowered by the same stroke as the lift stroke and then said one hydraulic cylinder is reversely actuated so that the hooks are disengaged from the lug pieces of the door. In the case of the prior art door lifter of the type having a single hydraulic cylinder for lifting or lowering the door in two steps or strokes, there must be provided a hydraulic control circuit which is very complex in construction and expensive, but the use of two hydraulic cylinders can considerably simplify the hydraulic control circuit.

6 Claims, 8 Drawing Figures

DOOR LIFTER FOR COKE OVEN

BACKGROUND OF THE INVENTION

The present invention relates to a door lifter for coke ovens.

Conventional door lifters of the type, which are mounted on a coke pusher and a coke guide trolley, have made door removal in such a manner that a hydraulic cylinder is so operated that upper and lower hooks of the lifter are lifted to be placed into engagement with corresponding upper and lower lug pieces of the door. Thereafter latching bars of the door are released and the hydraulic cylinder is further so operated that the door is lifted by a predetermined height from the hooking level. Next, after the door is removed away from the door frame provided at the inlet of the coke oven, the door is further lifted with the hydraulic cylinder and maintained at a predetermined final height for cleaning or other purposes. In order to reengage the door with the door frame, the sequence for door removal must be exactly reversed.

To this end, the hydraulic control system or circuit for controlling the hydraulic cylinder must include memory means which can memorize not only a first height at which the hooks are engaged with the lug pieces but also a second height at which the door is removed away from the door frame. A typical example of such hydraulic control systems has been featured by the provision of three sets of solenoid operated valve circuits and two sub-cylinders for memorizing said first and second heights, respectively. As a result, the hydraulic control system is very complex in construction and is very expensive so that the door lifters themselves become expensive.

The present invention was made to overcome the above and other problems encountered in the prior art door lifters for coke ovens and has for its object to provide a door lifter for coke ovens which has a hydraulic control system which is very simple in construction and very easy in maintenance.

Another object of the present invention is to provide a door lifter which, even when the door is not in parallel with the door lifter, can correctly engage the hooks with the lug pieces of the door.

A further object of the present invention is to provide a door lifter of the type described above which can be manufactured at less costs.

The above and other objects, effects and features of the present invention will become more apparent from the following description of preferred embodiments thereof taken in conjunction with the accompanying drawings.

BRIEF DESCRIPTION OF THE DRAWINGS

Same reference numerals are used to designate similar parts throughout the figures.

DESCRIPTION OF THE PREFERRED EMBODIMENTS

Figure 3:
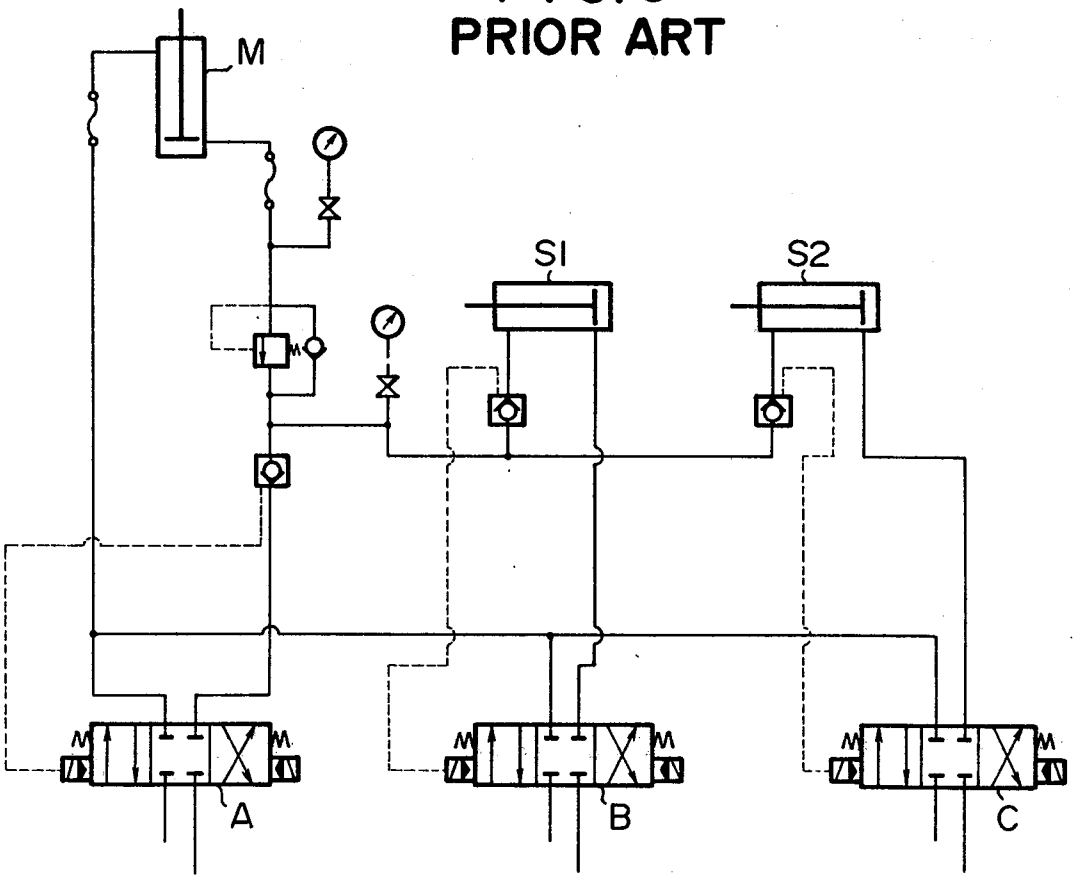
FIG. 3 PRIOR ART
FIG. 3 is a circuit diagram of the hydraulic control system of a prior art door lifter.

Prior Art, FIG. 3

Prior to the description of preferred embodiments of the present invention, the prior art door lifter will be briefly described with reference to FIG. 3 in order to more specifically point out the problems thereof. As described previously, the prior art door lifter employs a hydraulic cylinder control system comprising three sets of solenoid controlled valve circuits and two memory cylinders or sub-cylinders for storing the quantities of working liquid. Firstly, the solenoid controlled valve A is so actuated as to cause a main cylinder M to extend its piston rod, thereby engaging the hooks with the lug pieces of an oven door. After the hooks have been detected to have made into engagement with the lug pieces from the outputs from the limit switches mounted at the bottom of the hooks, the solenoid controlled valve A is returned to the neutral valve position. Thereafter, the solenoid controlled valve B is so actuated as to cause a sub-cylinder S1 to fully extend its piston rod and, the working liquid discharged from the sub-cylinder S1 due to the full extension stroke of its piston is charged into the main cylinder M in order to lift the door. Thus, a predetermined lift stroke of the door can be maintained. Next a solenoid controlled valve C is so actuated as to cause a sub-cylinder S2 to extend its piston rod and the working liquid discharged from the sub-cylinder S2 is also charged into the main cylinder M so that the latter's piston rod is fully extended and consequently the door is lifted further and maintained at a predetermined height for cleaning or other purposes. This second lift stroke is stored in the sub-cylinder S2 in terms of the stroke of its piston.

In order to lower the door for closing an oven chamber, first the solenoid controlled valve C is so actuated that the door is lowered by the stroke corresponding to the second lift stroke. Thereafter the solenoid controlled valve B is so actuated that the door is further lowered by the stroke equal to the first lift stroke and brought to a level on which the door is reengaged with the door frame. Finally the solenoid controlled valve A is so actuated that the piston rod of the main cylinder M is fully retracted whereby the hooks is disengaged from the lug pieces of the door. It is obvious that the hydraulic control system of the type described above is very complicated in construction and expensive in cost.

Figure 1:
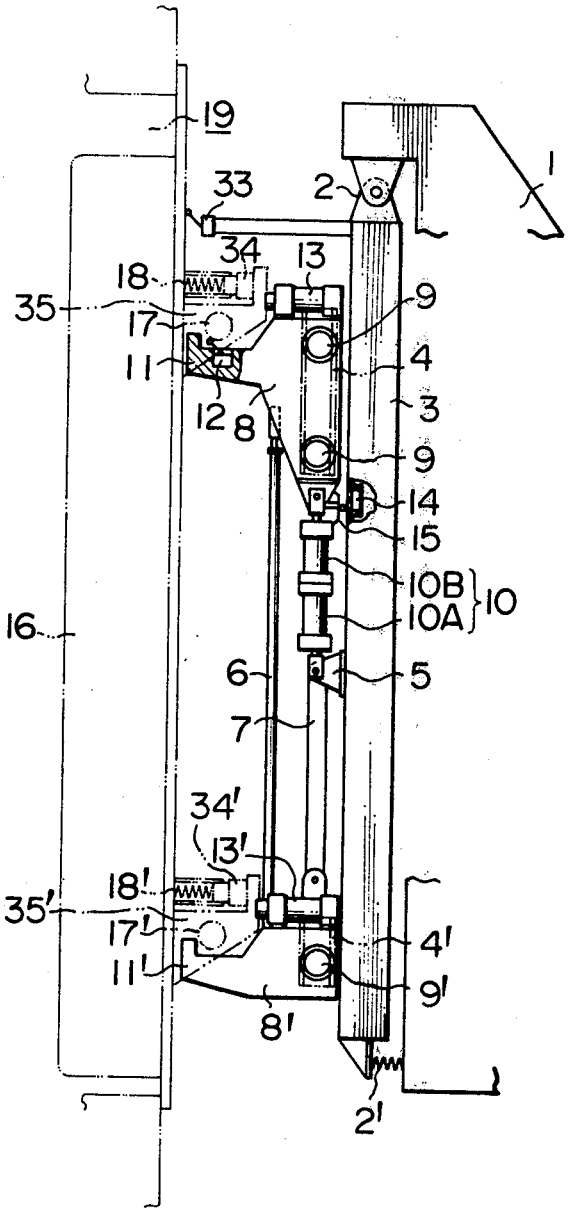
FIG. 1 is a side view of a first embodiment of a door lifter in accordance with the present invention.
Figure 2:
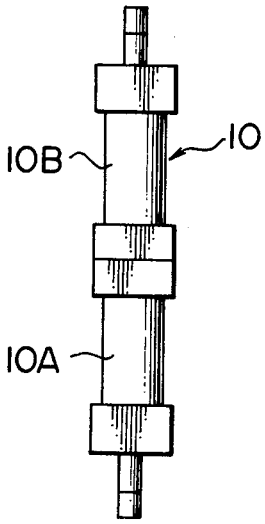
FIG. 2 is a side view, on enlarged scale, of a hydraulic cylinder assembly thereof.

First Embodiment, FIGS. 1 and 2

Referring to FIG. 1, a door lifter frame 3 has its upper end joined with an upper joint means 2 to a frame 1 movable on a coke oven handling machine and its lower end with a lower joint means 2' to the frame 1. More specifically, the upper end of the frame 3 is pivoted to the frame 1 while the lower end thereof is connected through a spring to the frame 1. An upper guide channel 4 and a lower guide channel 4' are vertically mounted on the frame 3 and spaced apart from each other by a suitable distance. An upper supporting arm 8 with a hook 11 and a lower supporting arm 8' with a hook 11' are connected to each other with connecting members 6 and 7. Guide rollers 9 carried by the upper supporting arm 8 are fitted into the upper guide channel 4 while a guide roller 9' carried by the lower supporting arm 8' is fitted into the lower guide channel 4'. The lower piston rod of a hydraulic cylinder assembly 10 is pivoted to a bracket 5 which in turn is securely mounted on the frame 3 between the upper and lower guide channels 4 and 4' while the upper piston rod of the assembly 10 is fastened to the upper supporting arm 8, whereby the upper and lower supporting arms 8 and 8' are lifted or lowered by the hydraulic cylinder assembly 10. A limit switch 12 is disposed at the bottom of the upper hook 11. Pushing cylinders 13 and 13' are mounted on the upper and lower supporting arms 8 and 8', respectively.

The construction of the hydraulic cylinder assembly 10 is shown in detail in FIG. 2. It consists of two cylinders 10A and 10B connected in series and in back-to-back relationship. One of them can be used for hooking while the other, for lifting. In this embodiment, the lower cylinder 10A is used for hooking while the upper cylinder 10B, for lifting, but it is obvious to those skilled in the art that the lower cylinder 10A may be used for lifting while the upper cylinder 10B, for hooking.

When the upper hook 11 engages with a lug piece 17, the rod extension stroke of the lower cylinder 10A is stopped in response to the output from the limit switch 12, whereby the lower cylinder 10A holds the upper and lower supporting arms 8 and 8' in the hooking position.

A limit switch 14 is mounted on the frame 3 and a striker 15 for actuating the limit switch 14 is extended from the extreme end of the piston rod of the upper cylinder 10B. When the piston rod of the upper cylinder 10B is retracted and the end of the piston rod is lowered to a predetermined height, the striker 15 engages with the limit switch 14 so that in response to the output from the switch 14 the retraction stroke of the upper cylinder 10B is stopped, whereby a door 16 is lifted to and maintained at a predetermined lift position.

Next the mode of operation of the door lifter with the above-described construction will be described. When the lower or hooking cylinder 10A is so actuated as to extend its piston rod, the upper and lower supporting arms 8 and 8' are lifted while the guide rollers 9 and 9' being guided by the guide channels 4 and 4'. When the upper and lower hooks 11 and 11' engage with the lug pieces 17 and 17', respectively, of the door 16, the rod extension stroke of the lower cylinder 10A is stopped in response to the output signal from the limit switch 11. Thereafter the pushing cylinders 13 and 13' are so actuated as to extend their piston rods to push latching bars 34 and 34' of the door 16 against springs 18 and 18', thereby releasing them from hook ends of latching arms 35 and 35' extended from the door frame.

Thereafter the upper or lifting cylinder 10B is so actuated as to fully extend its piston rod, thereby lifting the door 16. In this case, the lower cylinder 10A is locked to hold its piston rod at the position relative to the cylinder 10A at which the hooks 11 and 11' have engaged with the lug pieces 17 and 17' of the door.

Next the upper cylinder 10B is actuated to fully extend its piston rod thereby lifting the door 16 from the hooking position by a predetermined height corresponding to the full stroke of the piston. Thereafter the door 16 is removed away from the door frame and the cylinder 10B is so actuated as to retract its piston rod. When the striker 15 at the extreme end of this piston rod engages with the limit switch 14, the rod retraction stroke is stopped and the upper cylinder 10B is locked in this position. As a result, the door is maintained at a predetermined height for cleaning or other purpose by the upper and lower cylinders 10A and 10B both of which are now being locked. The height of the lifted door 16 may be selected as needed by changing the level of the limit switch 14 on the frame 3.

In order to engage the door 16 with the door frame, the upper cylinder 10B is so actuated as to fully extend its piston rod so that the door 16 is lifted to the uppermost position. After the lifted door 16 has been aligned with and put into the inlet aperture 19 of the oven, the door 16 is lowered by actuating the upper cylinder 10B so as to retract its piston rod. When the piston rod of the upper cylinder 10B is completely retracted, the door 16 is lowered to the locking position which is maintained by the locked lower cylinder 10A. Thereafter, the piston rods of the pushing cylinders 13 and 13' are retracted so that the door 16 is locked by the latching bars 34 and 34' brought into engagement with the latching arms 35 and 35'. Next the lower cylinder 10A is so actuated as to retract its piston rod so that the upper and lower hooks 11 and 11' are released from the lug pieces 17 and 17'.

In summary, according to the present invention, the hydraulic power cylinder assembly consisting of the cylinders 10A and 10B connected in series and in backto back relationship is used for lifting or lowering the oven door 16. One of the cylinders is used for hooking while the other, for lifting or lowering. Position sensors such as the limit switches 12 and 14 are provided in order to control the extension and retraction strokes of the cylinders 10A and 10B so that the door 16 can be maintained at the predetermined heights. The height of the door 16 finally maintained for cleaning or other purposes is lower than that in the case of the prior art door lifter as explained with reference to FIG. 3, since the door 16 is lowered from the first height at which the door 16 is removed away from the door frame of the oven to the position at which the striker 15 engages with the limit switch 14. It is to be noted that if the door 16 is arranged to be further lifted up from the first height for cleaning as in the case of the prior art door lifter, a sub-cylinder for memorizing the second lift stroke would be required. Thus, the door lifter of the present invention is very simple in construction yet capable of positively and easily memorizing the hooking position and maintaining the door at the predetermined position without employment of the complex hydraulic control circuit and the sub-cylinders of the prior art door lifter. In addition, the present invention can considerably simplify the hydraulic circuits so that maintenance can be simplified and manufacturing costs can be considerably reduced. Furthermore, as compared with the prior art door lifter of the type described, the present invention permits the simple and easy adjustment of the door lifting position or height.

Second Embodiment, FIGS. 4 through 8

The second embodiment to be described in detail with reference to FIGS. 4 through 9 is substantially similar in construction to the first embodiment described above except the upper and lower frame supporting means 2 and 2'.

Figure 5:
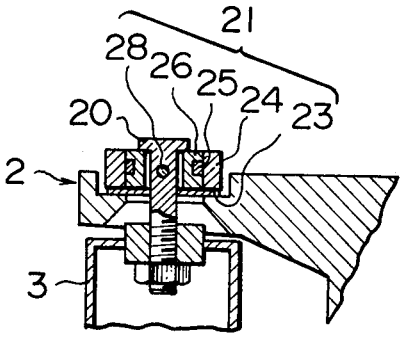
FIG. 5 is a side view in section of an upper frame supporting means.
Figure 6:
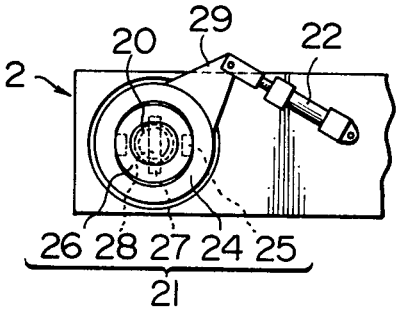
FIG. 6 is a top view thereof.

The construction of the upper frame supporting means 2 is shown in detail in FIGS. 5 and 6. With this supporting means, the frame 3 not only can be swung in any direction relative to the vertical but also can be rotated through 90° by virtue of a hydraulic cylinder 22 for cleaning the door and so on.

The supporting means 2 includes a universal joint generally indicated by the reference numeral 21 consisting of a vertical shaft 20 threadably secured to the upper end of the frame 3, an inner ring 26 surrounding the vertical shaft 20, and an outer ring 25 surrounding the inner ring 26 and seated through thrust bearings 23 in a recess formed at the upper end of the movable frame 1. A pair of pins 25 are forwardly and backwardly extended from the inner periphery of the outer ring 24 and pivotably support the inner ring 26. A pivot pin 28 is extended through the vertical shaft 20 at right angles thereto and has their ends pivotably fitted into a pair of holes 27 of the inner periphery of the inner ring 26 which are diametrically spaced apart from each other and are angularly spaced apart from the pins 25 of the outer ring 24 by 90°.

The base of the hydraulic cylinder 22 is pivotably connected to the movable frame 1 while the piston rod is pivoted to the arm 29 extended from the outer ring 24.

Figure 7:
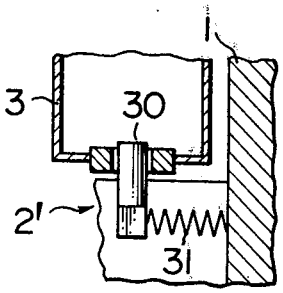
FIG. 7 is a side view, in cross section, of a lower frame supporting means.
Figure 8:
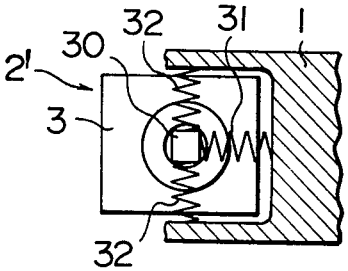
FIG. 8 is a bottom view thereof.

The construction of the lower frame supporting means 2' is shown in detail in FIGS. 7 and 8. A vertical shaft 30, the upper end of which is inserted into a ring fixed to the bottom wall of the frame 3 in such a way as to permit the relative rotation between the shaft 30 and the ring, is arranged to push the lower portion of the frame 3 slightly forwardly so that the frame 3 is inclined backwardly. The lower portion of the vertical shaft 30 is connected to the movable frame 1 through an elastic means 31 for supporting the vertical shaft 30 in the forward and backward directions and an elastic means 32 for supporting the shaft 30 in the lateral directions.

Figure 4:
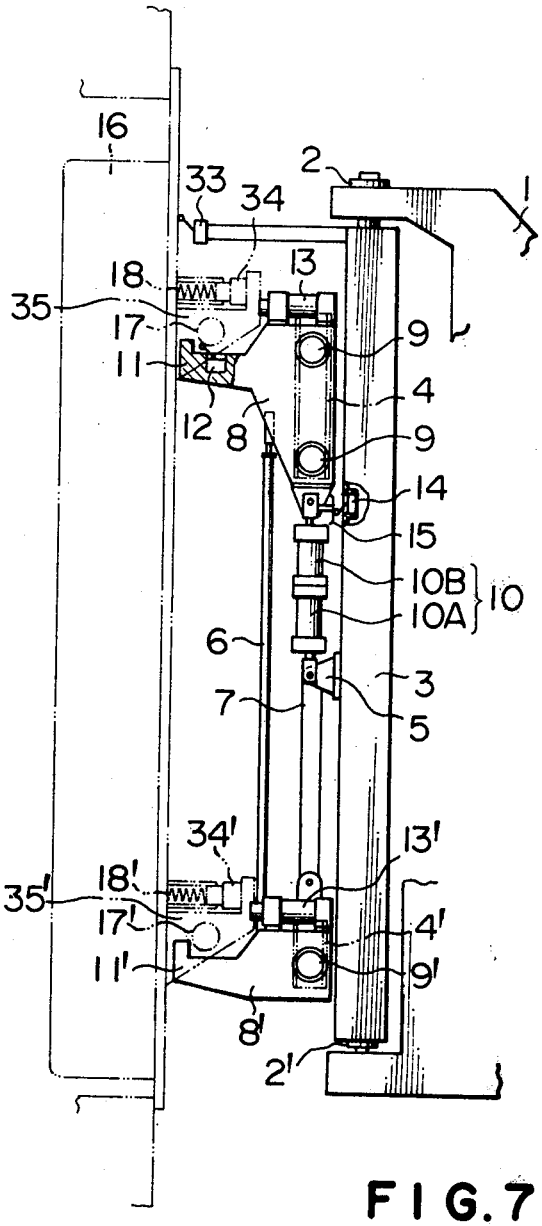
FIG. 4 is a side view of a second embodiment of the present invention.

Referring to FIG. 4, the frame 3 includes a limit switch 33 mounted at the forward end of a supporting rod extended forwardly from the frame 3. The limit switch 33 is closed when the hooks 11 and 11' are advanced to the positions below the lug pieces 17 of the door for hooking the same and in response to the signal from the limit switch 33, the advancement of the movable frame 1 is stopped.

With the upper and lower supporting means 2 and 2' as shown in FIGS. 5 to 8, when the movable frame 1 has been advanced to the hooking-ready position, the frame 3 can be brought to stand in parallel to the door 16 not only in the case of the forwardly inclined door but also in the case of the backwardly inclined door, since the frame 3 is connected as its lower end to the movable frame 1 through the elastic means 31. Furthermore, even when the outer surface of the door 16 is not in parallel with the front surface of the movable frame 1, the frame 3 is rotated by actuating the hydraulic cylinder 22 so that the hooks 11 and 11' are correctly aligned with the lug pieces 17 and 17' for hooking them.

After the hooks 11 and 11' are advanced to the hooking-ready positions below the lug pieces 17 and 17', as with the first embodiment, the lower and hooking cylinder 10A is so actuated as to extend its piston until the engagement of the upper hook 11 with the lug piece 17 of the door is detected from the output signal from the limit switch 12 at the bottom of the hook 11. After the lug pieces 17 and 17' have been hooked, the pushing cylinders 13 and 13' are actuated to extend their piston rods to release the latching bars 34 and 34'. Thereafter, the upper or lifting cylinder 10B is so actuated as to extend its piston fully so that the door 16 is lifted. When the cleaning of the lifted door 16 is needed, the hydraulic cylinder 22 is so actuated that the frame 3 and hence the door 16 are rotated through 90°. Next the upper cylinder 10B is so actuated as to retract its piston rod until the striker 15 actuates the limit switch 14. Thus the door 16 can be maintained at a predetermined lifted position. The reengagement of the door 16 is a reversal of the sequence of the door removal described above.

In summary, according to the second embodiment of the present invention, even when the oven door 16 is inclined forwardly or backwardly or is not in parallel with the movable frame 1, the hooks 11 and 11' can be correctly aligned with the lug pieces 17 and 17' of the door 16. In addition, the lifted door 16 can be rotated through 90° about the vertical axis of the frame 3 without causing the movable frame 1 to rotate. As a result, the cleaning of the lifted door is much facilitated.

What is claimed is:

1. A door lifter for coke ovens comprising:

a movable frame movable toward or away from an oven door;

a frame suspended vertically from said movable frame;

means for suspending said frame from said movable frame;

a movable member with at least one hook which is movable vertically along said suspended frame; and actuator means mounted on said suspended frame and connected to the movable member for causing the vertical movement of said movable member, said actuator means comprising two hydraulic cylinders connected in series and in back-to-back relationship with a common axis of said two hydraulic cylinders in parallel with the path for vertical movement of said movable member, each cylinder having a piston rod; and a control system to control said two hydraulic cylinders comprising:

first means connected to one of said two hydraulic cylinders for actuating said one of said two hydraulic cylinders to lift said movable member:

means associated with said first means for actuating for sensing the engagement of said at least one hook with a lug piece of said door and thereupon stopping and locking said one hydraulic cylinder;

second means connected to the other of said two hydraulic cylinders and said means for sensing for actuating the other hydraulic cylinder upon the stopping and locking of the one hydraulic cylinder to lift said door to the stroke end of said piston rod of said other hydraulic cylinder, and thereafter to lower said door; and means for sensing the lowering of said door and for stopping said second means and locking said other hydraulic cylinder when said door reaches a predetermined height;

all of said means of said control system being reversible.

2. A door lifter as set forth in claim 1 wherein said means for sensing engagement comprises a limit switch which is embedded in the bottom of said hook and is adapted to be actuated when said hook engages with said lug piece of said door.

3. A door lifter as set forth in claim 1 or 2 wherein said means for sensing lowering comprises a second limit switch which is mounted on said suspended frame, and a striker is mounted on said movable member for actuating said second limit switch when said door is lowered to said predetermined height.

4. A door lifter as set forth in claim 1 wherein said means for suspending comprises a universal joint means at an upper end of said frame and means for elastically supporting said frame at a lower end so that said lower end is movable forwardly, backwardly and laterally and rotatable about its axis.

5. A door lifter as set forth in claim 4 wherein said suspended frame is arranged to be inclined backwardly with its lower end being spaced away from said movable frame more than its upper end.

6. A door lifter as set forth in claim 4 wherein said means for suspending further comprises a hydraulic cylinder mounted on said movable frame and operatively coupled to said suspended frame such that the latter can be rotated about its longitudinal axis.

* * * * *